US005779316A

United States Patent [19]

Sugawa et al.

[11] Patent Number: 5,779,316

[45] Date of Patent: Jul. 14, 1998

[54] DEVICE FOR EXTENDING AND RETRACTING A FOOTREST OF A CHAIR

[75] Inventors: Akihide Sugawa; Masamichi Miyaguchi; Makoto Fukutani; Fumihiro Nishio, all of Hikone, Japan

[73] Assignee: Matsushita Electric Works, Ltd., Osaka, Japan

[21] Appl. No.: 647,777

[22] Filed: May 15, 1996

[30] Foreign Application Priority Data

May 19, 1995 [JP] Japan ..... 7-121808

[51] Int. Cl.[6] ..... A47C 7/50

[52] U.S. Cl. ..... 297/423.26; 74/501.6; 74/108; 74/489; 74/538; 297/68; 297/85

[58] Field of Search ..... 297/423.26, 423.19, 297/85, 463.1, 68, 84; 74/501.6, 108, 489, 538

[56] References Cited

U.S. PATENT DOCUMENTS

| | | | |
|---|---|---|---|
| 1,442,830 | 1/1923 | Schneider | 74/538 |
| 1,974,973 | 9/1934 | Paul | 74/538 |
| 2,963,077 | 12/1960 | Knabusch et al. | 297/423.26 X |
| 3,695,701 | 10/1972 | Knabusch et al. | 297/423.26 X |
| 4,410,215 | 10/1983 | McKean et al. | 297/423.26 X |
| 4,506,925 | 3/1985 | Crum | 297/423.26 X |
| 4,574,786 | 3/1986 | Hashimoto et al. . | |
| 4,668,009 | 5/1987 | Talley et al. | 297/68 X |
| 4,681,365 | 7/1987 | Pine | 297/68 X |
| 4,696,512 | 9/1987 | Burnett et al. | 297/68 |
| 4,707,025 | 11/1987 | Rogers, Jr. | 297/85 X |
| 5,010,780 | 4/1991 | Hatfield | 74/538 X |
| 5,169,208 | 12/1992 | Re et al. | 297/85 |
| 5,354,116 | 10/1994 | May et al. | 297/85 |
| 5,368,366 | 11/1994 | Mizelle | 297/85 X |
| 5,374,101 | 12/1994 | Wiecek | 297/85 |
| 5,497,676 | 3/1996 | Barnard | 297/463.1 X |
| 5,505,519 | 4/1996 | Natt | 297/423.26 X |

*Primary Examiner*—Peter M. Cuomo
*Assistant Examiner*—Stephen Vu
*Attorney, Agent, or Firm*—Greenblum & Bernstein P.L.C.

[57] ABSTRACT

A chair type massaging apparatus comprising: a seat; a footrest which is pivotally mounted on a front end portion of the seat; a pivotal member for pivoting the footrest between a projecting position at which the footrest is substantially horizontally projected forwardly of the seat and a retractive position at which the footrest is retracted below the seat substantially vertically; an operating lever for actuating the pivotal member and a locking portion for effecting or cancelling locking of the footrest at a predetermined pivotal angle between the projecting position and the retractive position, which is provided on the operating lever.

14 Claims, 7 Drawing Sheets

DEVICE FOR EXTENDING AND RETRACTING A FOOTREST OF A CHAIR

BACKGROUND OF THE INVENTION

The present invention relates to a chair type massaging apparatus.

Usually, in conventional chair type massaging apparatuses, a footrest is pivotally mounted on a front end portion of a seat and is fixed by a link reversing mechanism or a coiled spring at a projecting position where the footrest is substantially horizontally projected forwardly of the seat and a retractive position where the footrest is retracted below the seat substantially vertically.

In these known massaging apparatuses, since the footrest can be fixed only at the projecting position and the retractive position, such a phenomenon may happen that a user cannot take an easy attitude when he undergoes massaging by placing his feet on a footrest having a built-in massaging mechanism. For example, in case massaging is performed by setting the footrest horizontally without tilting a backrest of the chair, his body is bent in an L-shaped figure with his feet stretched straightforwardly. Thus, when he sits on the massaging apparatus for a long time, load is applied to his low back, which is quite hard especially for the aged, the physically handicapped and those suffering from low back pain or rheumatism. On the other hand, in case massaging is performed by tilting the backrest of the chair and setting the footrest horizontally, the user's feet are likely to be spaced away from the footrest, thereby resulting in marring of massaging effect.

Meanwhile, massaging apparatuses have also been proposed in which the footrest can be set at a plurality of positions by using a brake or a ratchet. However, since operating efficiency of these known massaging apparatuses is poor, the known massaging apparatuses are difficult to operate.

SUMMARY OF THE INVENTION

Accordingly, an essential object of the present invention is to provide, with a view to eliminating the above mentioned disadvantages of prior art, a massaging apparatus in which a footrest can be locked at a location intermediate between a projecting position and a retractive position and locking of the footrest can be cancelled easily such that both usability and operating efficiency of the massaging apparatus can be improved.

Another object of the present invention is to provide a massaging apparatus in which not only risk of abrupt drop of the footrest is eliminated so as to secure operational safety of the massaging apparatus by preventing displacement of the footrest due to inadvertent operation of a locking button such as sudden impact applied to the locking button and children's mischief but operating efficiency of the massaging apparatus is further improved by providing the locking button at a portion of the operating lever held in contact with a palm of the user at all times.

In order to accomplish these objects of the present invention, a chair type massaging apparatus according to the present invention comprises: a seat; a footrest which is pivotally mounted on a front end portion of the seat; a pivotal means for pivoting the footrest between a projecting position at which the footrest is substantially horizontally projected forwardly of the seat and a retractive position at which the footrest is retracted below the seat substantially vertically; an operating lever for actuating the pivotal means; and a locking portion for effecting or cancelling locking of the footrest at a predetermined pivotal angle between the projecting position and the retractive position, which is provided on the operating lever.

It is preferable that the locking portion includes a depressible locking button and the massaging apparatus further comprises a locking mechanism for locking the locking button in one of a depressed state and a nondepressed state of the locking button. Meanwhile, the footrest is preferably locked at a plurality of pivotal angles between the projecting position and the retractive position by the locking portion.

Furthermore, the locking button is preferably provided on a side face of the operating lever. Meanwhile, it is preferable that the operating lever is pivoted through not less than 90° and the locking button is provided on an outer side face of the operating lever as viewed from the seat.

In the present invention, the footrest is pivoted by the operating lever between the projecting position at which the footrest is substantially horizontally projected forwardly of the seat and the retractive position at which the footrest is retracted below the seat substantially vertically, while the locking portion for effecting and cancelling locking of the footrest at the predetermined pivotal angle between the projecting position and the retractive position is provided on the operating lever.

Therefore, by operating the locking portion, the footrest can be locked at a location intermediate between the projecting position and the retractive position. Thus, even when the footrest is used without tilting a backrest, the user can take an easy attitude free from low back pain for a long time by directing his feet obliquely downwardly and thus, the massaging apparatus can be operated easily. Furthermore, since the locking portion can be operated simultaneously with operation of the operating lever, angular adjustment of the footrest is facilitated and thus, the massaging apparatus can be operated quite easily.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 2:
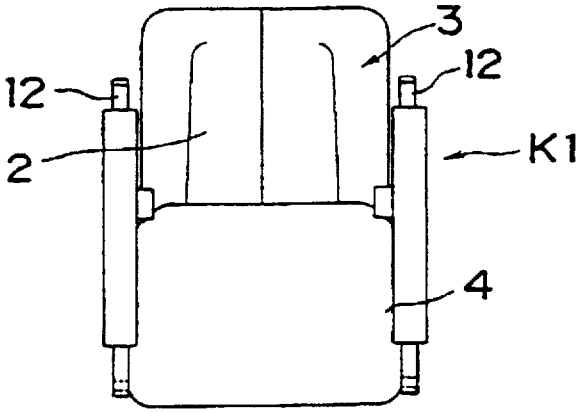
FIG. 2 is a top plan view of the massaging apparatus of FIG. 1.
Figure 1:
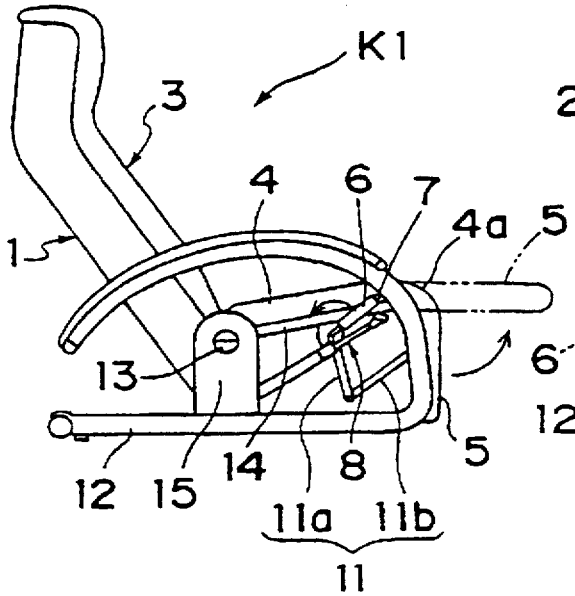
FIG. 1 is a side elevational view of a massaging apparatus according to a first embodiment of the present invention.
Figure 3:
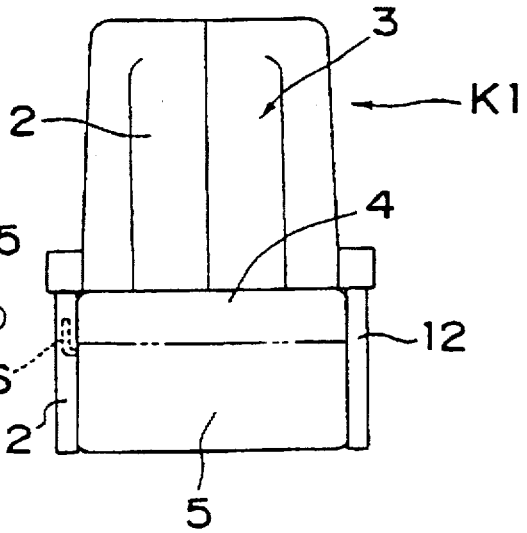
FIG. 3 is a front elevational view of the massaging apparatus of FIG. 1.
Figure 4:
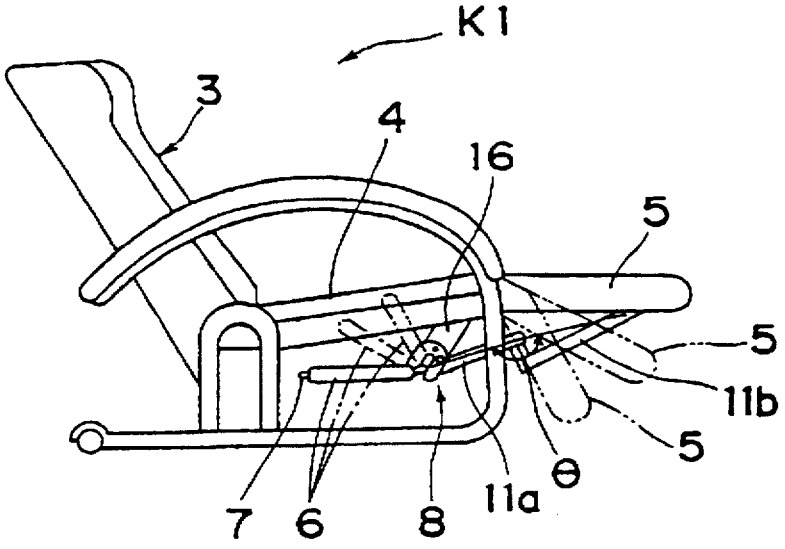
FIG. 4 is a side elevational view explanatory of positional relation between an operating lever and a footrest of the massaging apparatus of FIG. 1.

As shown in FIGS. 1 to 3, a chair type massaging apparatus K1 according to a first embodiment of the present includes a backrest 3, a seat 4, a footrest 5 pivotally mounted on a front end portion 4*a* of the seat 4 and a single-handed operating lever 6 having a locking portion 7. The backrest 3 has a cover 2 for covering massaging rollers.

The footrest 5 is pivotally provided so as to be pivoted, by operating the operating lever 6, between a projecting position at which the footrest 5 is substantially horizontally projected forwardly of the seat 4 and a retractive position at which the footrest 5 is retracted below the seat 4 substantially vertically. The footrest 5 may incorporate a vibration type or a roller type massaging mechanism or may not incorporate the massaging mechanism.

A two-link link mechanism 11 including links 11*a* and 11*b* is coupled with the operating lever 6. As will be described later, the link 11*a* is secured to a driving pipe 10 of a locking mechanism 8 by welding or the like, while the link 11*b* is fixed to the footrest 5. The link mechanism 11 may include three links in place of the two links. The links 11*a* and 11*b* of the link mechanism 11 are coupled with each other in a V-shaped configuration as shown in FIG. 1. As the footrest 5 is gradually shifted from the retractive position to the projecting position or vice versa, angle between the links 11*a* and 11*b* increases or decreases such that angle of the footrest 5 relative to the seat 4 is variable between the retractive position and the projecting position. At the projecting position of the footrest 5, the links 11*a* and 11*b* are set in an inverse state, namely, angle between the links 11*a* and 11*b* exceeds 180° and thus, the footrest 5 is securely held at the projecting position by the links 11*a* and 11*b*. Meanwhile, in FIG. 1, reference numeral 12 denotes an arm pipe, reference numeral 13 denotes a reclining lever for the backrest 3, reference numeral 14 denotes a frame under the seat 4 and reference numeral 15 denotes a link cover. Therefore, a pivotal means for pivoting the footrest 5 between the projecting position and the retractive position includes the driving pipe 10 and the two-link link mechanism 11 and is actuated by the operating lever 6 so as to pivot the footrest 5 between the projecting position and the retractive position.

Figure 6:
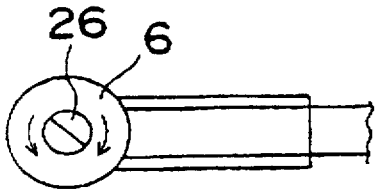
FIG. 6 is a top plan view of a locking button of the operating lever of FIG. 4.
Figure 7:
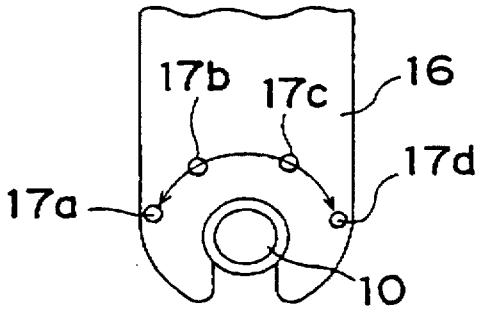
FIG. 7 is a front elevational view of a support rod of the massaging apparatus of FIG. 1.
Figure 5:
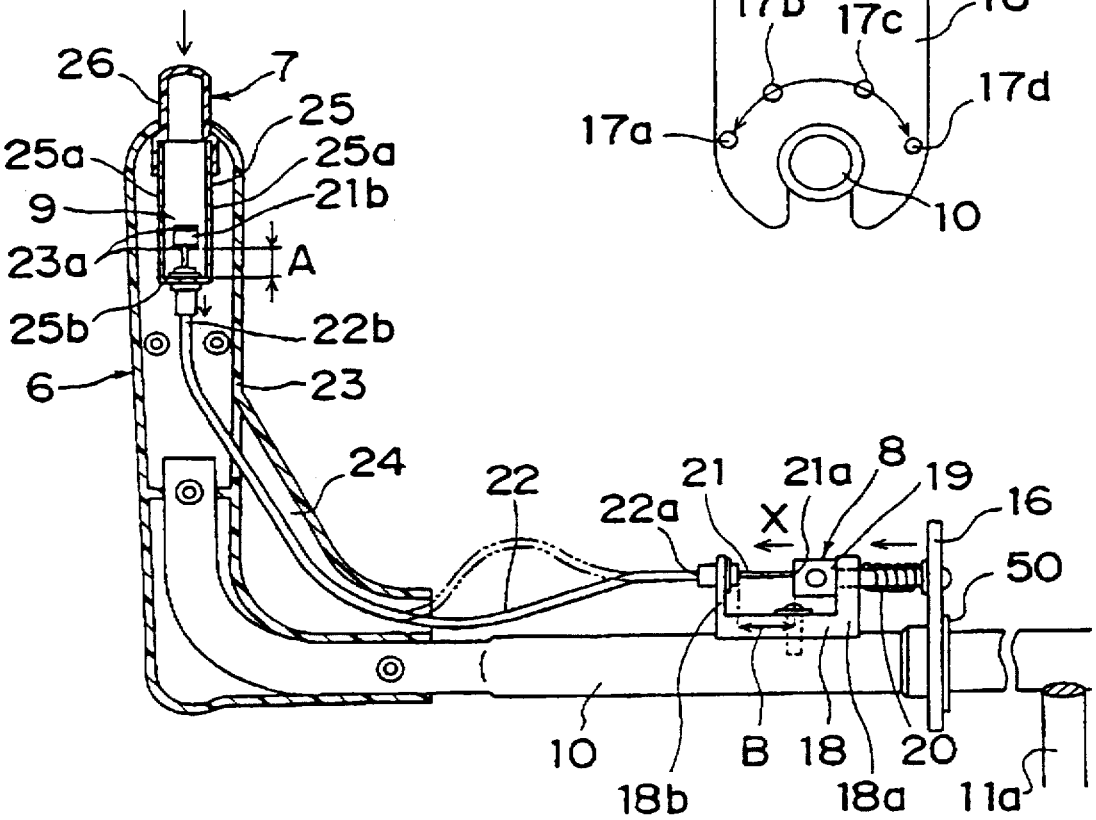
FIG. 5 is a sectional view explanatory of a locking mechanism for locking the operating lever of FIG. 4.
Figure 8:
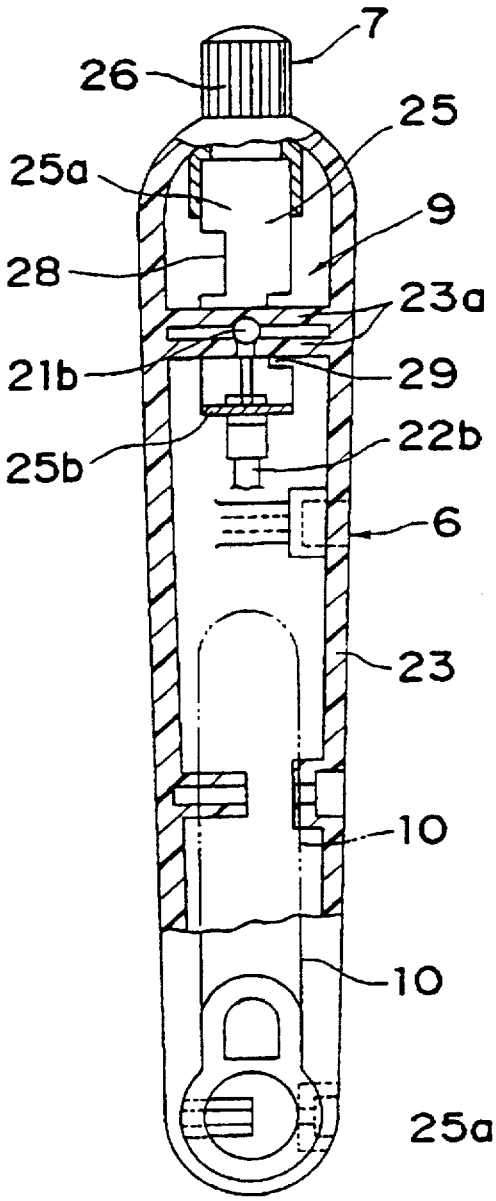
FIG. 8 is a sectional view of the operating lever of FIG. 4.
Figure 9:
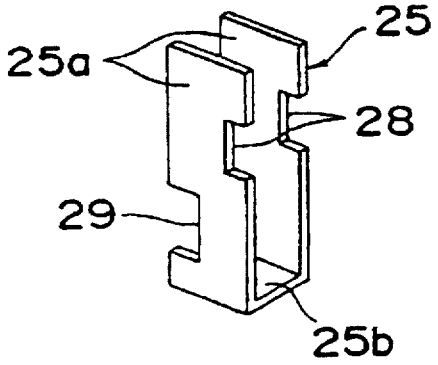
FIG. 9 is a perspective view of a push fitment of the operating lever of FIG. 8.
Figure 10:
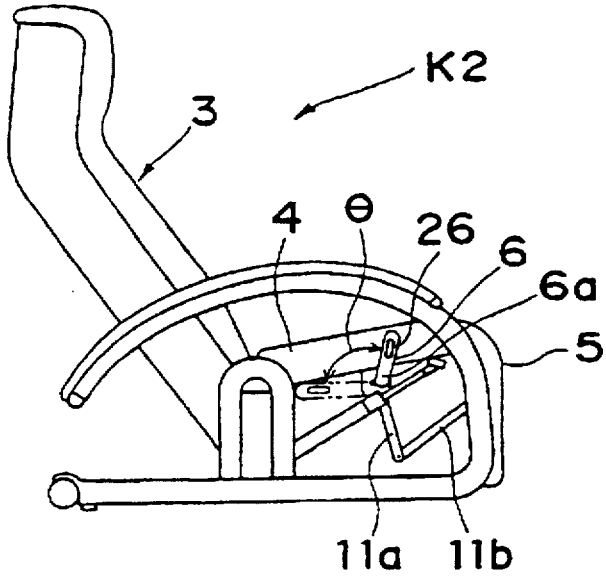
FIG. 10 is a side elevational view of a massaging apparatus according to a second embodiment of the present invention.
Figure 11:
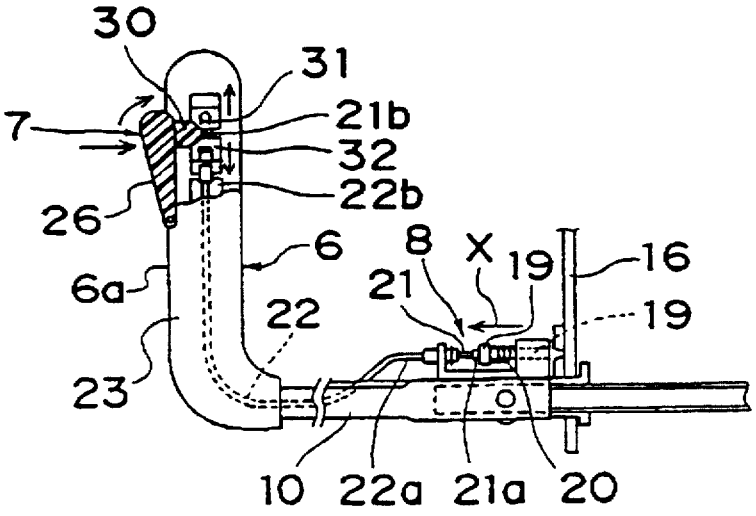
FIG. 11 s a partially broken side elevational view of an operating lever and a driving pipe of the massaging apparatus of FIG. 10.

FIGS. 5 to 7 show the locking mechanism 8 f or locking the operating lever 6, while FIGS. 8 and 9 show a locking mechanism 9 for locking a locking button 26 of the locking portion 7. Initially, the locking mechanism 8 of the operating lever 6 is described. Below the seat 4, the horizontally extending driving pipe 10 is rotatably supported through a bearing 50 by a support rod 16 secured to the seat 4. On the other hand, the operating lever 6 is provided at one side of the seat 4. A lower end portion of the operating lever 6 and one end of the driving pipe 10 are coupled with each other such that the driving pipe 10 is rotated about its own axis by rotating the operating lever 6.

As shown in FIG. 7, locking holes 17*a* to 17*d* are formed on the support rod 16 so as to be spaced in a rotational direction of the driving pipe 10. The locking hole 17*a* corresponds to the projecting position of the footrest 5, while the locking hole 17*d* corresponds to the retractive position of the footrest 5. The locking holes 17*b* and 17*c* correspond to two inclined positions intermediate between the projecting position and the retractive position. At one side of the support rod 16 adjacent to the operating lever 6, a U-shaped locking base 18 is fixed to the driving pipe 10.

The locking base 18 has opposite side walls 18*a* and 18*b* such that the side wall 18*a* is disposed more adjacent to the support rod 16 than the side wall 18*b* is. A locking pin 19 which can be detachably inserted into the locking holes 17*a* to 17*d* is slidably supported by the side wall 18*a*. A lever locking spring 20 is wound around the locking pin 19 between the locking base 18 and the support rod 16 so as to urge the locking pin 19 towards the support rod 16 at all times. A locking wire 21 having one end 21*a* coupled with the locking pin 19 is slidably passed through the side wall 18*b* of the locking base 18 and one end 22*a* of a wire tube 22 is attached to the side wall 18*b*. The other end 22*b* of the wire tube 22 is passed through a pipe passage 24 curved substantially arcuately towards inside of a lever pipe 23 of the operating lever 6 and is fixed to a push fitment 25 received in the lever pipe 23.

On the other hand, the locking portion 7 is provided at the operating lever 6 so as to effect or cancel locking of the footrest 5 at a predetermined pivotal angle between the projecting position and the retractive position, which locking is performed by the locking mechanism 8 for locking the operating lever 6. In the locking portion 7, the locking button 26 is mounted in an opening formed at an upper end of the lever pipe 23 so as to be depressed into the opening. A lower end of the locking button 26 is coupled with an upper end of the push fitment 25 received in the lever pipe 23. The locking button 26 and the push fitment 25 are urged by a return spring (not shown) to project out of the opening of the lever pipe 23.

As shown in FIG. 9, the push fitment 25 is formed into a U-shaped configuration having a pair of opposed side pieces 25*a* and a bottom piece 25*b* coupling lower ends of the side pieces 25*a* with each other. The other end 22*b* of the wire tube 22 whose one end 22*a* is secured to the side wall 18*b* of the locking base 18 as shown in FIG. 5 is attached to a lower face of the bottom piece 25*b* of the push fitment 25. Furthermore, the other end 21*b* of the locking wire 21 whose one end 21*a* is coupled with the locking pin 19 is slidably passed through the bottom piece 25*b* of the push fitment 25 and is brought into engagement with a rib 23*a* projecting from an inner surface of a wall of the lever pipe 23 so as to be fixed to the rib 23*a*. The rib 23*a* is so disposed as to be inserted in between the side pieces 25*a*.

As described above, the one end 2l*a* and the other end 21*b* of the locking wire 21 are, respectively, attached to the locking pin 19 and the rib 23*a* of the lever pipe 23, while the one end 22*a* and the other end 22*b* of the wire tube 22 are, respectively, fixed to the locking base 18 and the push fitment 25. Therefore, when the push fitment 25 is pushed downwardly by depressing the locking button 26, distance between the opposite ends 22*a* and 22*b* of the wire tube 22 is reduced and thus, the wire tube 22 is deflected as shown by the imaginary line in FIG. 5.

Namely, assuming that character A denotes a distance a distance between the other end 21*b* of the locking wire 21 and the other end 22*b* of the wire tube 22 prior to depression of the locking button 26 and character $\alpha$ denotes a push amount of the push fitment 25, a distance between the other end 21*b* of the locking wire 21 and the other end 22*b* of the wire tube 22 becomes $(A+\alpha)$ and thus, the wire tube 22 is deflected by the push amount $\alpha$. As a result, the locking wire 21 is pulled in the direction of X in FIG. 5. Therefore, assuming that character B denotes a distance between the one end 21*a* of the locking wire 21 the one end 22*a* of the wire tube 22 prior to depression of the locking button 26, a distance between the one end 21*a* of the locking wire 21 and the one end 22*a* of the wire tube 22 becomes $(B-\alpha)$, so that the locking pin 19 is pulled out of the support rod 16.

On the other hand, when depression of the locking button 26 is cancelled, the push fitment 25 is lifted, so that distance between the opposite ends 22*a* and 22*b* of the wire tube 22 is increased and thus, the wire tube 22 is stretched again as shown by the solid line in FIG. 5 such that the locking pin 19 is inserted into one of the locking holes 17*a* to 17*d* by urging force of the lever locking spring 20.

Furthermore, the locking button 26 is provided with the locking mechanism 9 for locking the locking button 26. Each of the side pieces 25*a* of the push fitment 25 which is displaced upwardly and downwardly in operative association with the locking button 26 as described above is formed, at its opposite sides, with rectangular upper and lower recesses 28 and 29, respectively as shown in FIG. 9. When the locking button 26 is rotated through 90° in one direction prior to its depression as shown in FIG. 6, the push fitment 25 is also rotated through 90° in the same direction, so that the lower recesses 29 of the side pieces 25*a* are brought into engagement with the rib 23*a* of the lever pipe 23 and thus, the locking button 26 is held in a state in which the locking button 26 cannot be depressed, namely, the locking pin 19 is held in engagement with the support rod 16.

Meanwhile, when the locking button 26 is rotated through 90° in the opposite direction in this state, the lower recesses 29 of the push fitment 25 are brought out of engagement with the rib 23*a* of the lever pipe 23 and thus, the locking button 26 can be reinstated to a state in which the locking button 26 can be depressed. Meanwhile, when the locking button 26 is rotated through 90° in one direction after its depression, the push fitment 25 is also rotated through 90° in the direction. As a result, the upper recesses 28 of the side pieces 25*a* of the push fitment 25 are brought into engagement with the rib 23*a* of the lever pipe 23 such that the locking button 26 is held in a state in which the locking button 26 has been depressed, namely, the locking pin 19 is detached from the support rod 16. On the contrary, when the locking button 26 is rotated through 90° in the opposite direction in this state, the push fitment 25 is rotated through 90° in the same direction, so that the upper recesses 28 of the push fitment 25 are brought out of engagement with the rib 23*a* of the lever pipe 23 such that the locking button 26 can be reinstated to a state in which the locking button 26 can be depressed.

When the footrest 5 is shifted from the retractive position to the inclined positions or the projecting position, a user grips an upper portion of the operating lever 6 with his single hand and depresses the locking button 26 with his finger. Therefore, the push fitment 25 is lowered, so that the wire tube 22 is deflected as shown by the imaginary line in FIG. 5 and thus, the locking pin 19 is pulled out of one of the locking holes 17*d* of the support rod 16 as described above. As a result, since the driving pipe 10 is rotatable relative to the support rod 16, the operating lever 6 is also rotatable relative to the support rod 16 and thus, the footrest 5 can be shifted from the retractive position to the projecting position via the inclined positions.

Subsequently, when the user releases his finger from the locking button 26, the push fitment 25 is lifted, so that the wire tube 22 is stretched as shown by the solid line in FIG. 5 and thus, the locking pin 19 is inserted into one of the locking holes 17*b* and 17*c* and the locking hole 17*a* of the support rod 16, which correspond to the inclined positions and the projecting position of the footrest 5, respectively. As a result, the driving pipe 10 cannot be rotated relative to the support rod 16 and thus, the operating lever 6 cannot be rotated relative to the support rod 16 such that the footrest 5 can be locked at one of the inclined positions and the projecting position. Meanwhile the footrest 5 can be returned to the retractive position from the inclined positions and the projecting position likewise.

The footrest 5 can be locked freely at a position between the projecting position and the retractive position by using the single-handed operating lever 6 as described above. Therefore, also in case, for example, the footrest 5 is used when the backrest 3 is not in a tilted orientation, the user can undergo massage comfortably by directing his feet obliquely downwardly. Therefore, the user can take an easy attitude free from low back pain for a long time. Accordingly, especially for the aged, the physically handicapped, those suffering from low back pain or rheumatism, load applied to their limbs can be lightened and angular adjustment of the footrest 5 can be made easily because the user can operate the locking portion 7 with his finger simultaneously while operating the operating lever 6 with his single hand, thereby resulting in remarkable operating efficiency of the massaging apparatus K1. Meanwhile, since the footrest 5 can be mechanically shifted between the retractive position and the projecting position by operating the operating lever 6, other components such as a motor and a power source are not required to be used, so that the massaging apparatus K1 can be simplified structurally, thus resulting in reduction of its production cost and ease of its maintenance.

Meanwhile the locking button 26 is provided with another locking mechanism 9. When the locking button 26 is rotated after having been depressed, the footrest 5 can be pivoted arbitrarily. On the other hand, when the locking button 26 is rotated without being depressed, the footrest 5 can be positively locked between the projecting position and the retractive position. Therefore, such an undesirable phenomenon can be eliminated that position of the footrest 5 changes due to the user's inadvertent operation of the locking button 26. Accordingly, it is possible to prevent undesirable displacement of the footrest 5 due to sudden impact applied to the locking button 26 or children's mischief. In addition, it is possible to raise operating efficiency of the massaging apparatus K1 when the massaging apparatus K1 is used only at the projecting position of the footrest 5.

In this embodiment, since the mechanism for bringing the locking pin 19 and the support rod 16 into engagement with each other is employed in combination with the link mechanism 11, reliability of strength of the footrest 5 can be improved even at the projecting position of the footrest 5, at which the maximum load is applied to the footrest 5. Meanwhile, in case the footrest 5 incorporates a massaging mechanism, massaging power of the footrest 5 is gradually reduced from the projecting position to the retractive position and thus, can be changed easily by operating the operating lever 6. Furthermore, in this case, massaging effect can be further heightened when stimulation given to the user's feet by the footrest 5 is changed by changing angle of the footrest 5 from the inclined positions to the projecting position or vice versa during massaging.

Meanwhile, in this embodiment, the two inclined positions of the footrest 5 are provided in addition to the projecting position and the retractive position of the footrest 5. However, by increasing the number of the locking holes 17*b* and 17*c* of the support rod 16 to three or more, three or more inclined positions of the footrest 5 may also be provided in place of the two inclined positions of the footrest 5. In this case, when the footrest 5 is returned from the inclined position to the retractive position, the locking pin 19 is automatically locked into the subsequent neighboring one of the locking grooves 17*b* and 17*c* by the lever locking spring 20 even if the user releases his hand from the operating lever 6 in an unlocking state. Therefore, such a risk as rapid retraction of the footrest 5 upon release of the user's hand from the operating lever 6, for example, abrupt drop of the footrest 5 is prevented, thereby resulting in rise of safety of the massaging apparatus K1. Meanwhile, a device assembled with a power transmission unit for increasing speed change ratio, for example, a speed change gear may also be incorporated between the operating lever 6 and the driving pipe 10. In this case, by displacing the operating lever 6 only a little, pivotal stroke of the footrest 5 is increased, thus resulting in further improvement of usability of the massaging apparatus K1.

FIGS. 10 to 19 show a massaging apparatus K2 according to a second embodiment of the present invention. In this embodiment, the locking button 26 is provided on an outer side face 6*a* of the operating lever 6 which is pivoted through not less than 90°. This locking button 26 is hinged to an outer side face of the lever pipe 23 such that the locking button 26 can be depressed laterally. A boss 30 is provided on a rear face of the locking button 26 so as to be projected into the lever pipe 23. Upper and lower lever links 31 and 32 are slidably supported by the lever pipe 23 so as to be, respectively, brought into contact with upper and lower faces of the boss 30. The upper lever link 31 is coupled with the other end 21*b* of the locking wire 21, while the lower lever link 32 is coupled with the other end 22*b* of the wire tube 22. When the locking button 26 is depressed, the upper and lower lever links 31 and 32 are thrust away from each other by the boss 30, so that distance between the upper and lower lever links 31 and 32 is increased and thus, distance between the other end 21b of the locking wire 21 and the other end 22*b* of the wire tube 22 increases. As a result, the wire tube 22 is deflected and thus, the locking pin 19 is pulled out of the support rod 16 by the wire 21 against urging force of the lever locking spring 20 in the same manner as FIG. 5.

Meanwhile, when depression of the locking button 26 is cancelled, distance between the upper and lower links 31 and 32 is reduced, so that distance between the other end 21*b* of the locking wire 21 and the other end 22*b* of the wire tube 22 decreases. As a result, the wire tube 22 is stretched, so that the locking pin 19 is urged by the lever locking spring 20 to be brought into engagement with the support rod 16 and thus, the same effects as the first embodiment can be gained. Meanwhile, in this embodiment, the wire tube 22 is directly drawn from the driving pipe 10 in contrast with the first embodiment in which the wire tube 22 is drawn from the lever pipe 23 through the pipe passage 24 as shown in FIG. 5.

Figure 12:
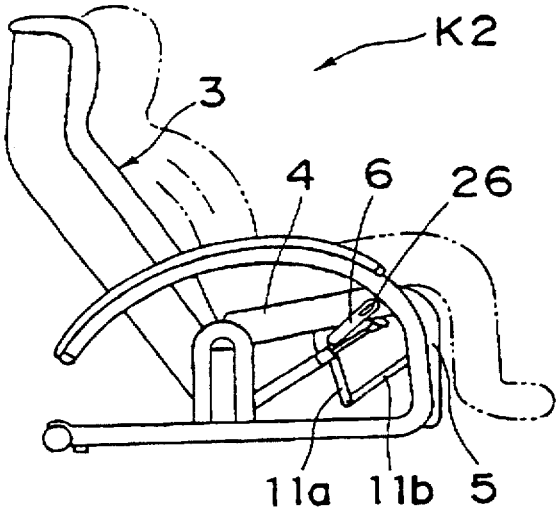
FIG. 12 is a side elevational view of the massaging apparatus of FIG. 10 in use.
Figure 13:
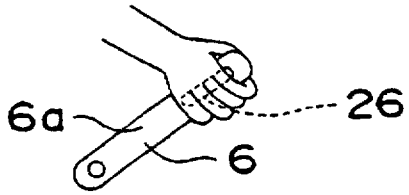
FIG. 13 is a fragmentary side elevational view of the operating lever of, FIG. 11 gripped by a hand of a user.
Figure 14:
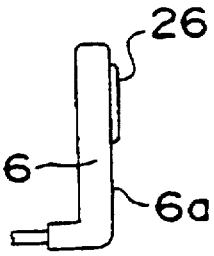
FIGS. 14 to 17 are a rear elevational view, a left side elevational view, a front elevational view and a right side elevational view of the operating lever of FIG. 11, respectively.
Figure 15:
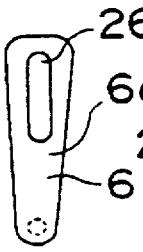
Figure 16:
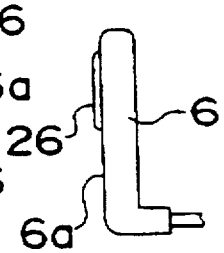
Figure 17:
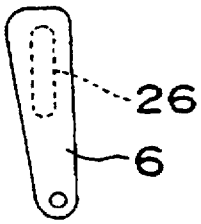
Figure 18:
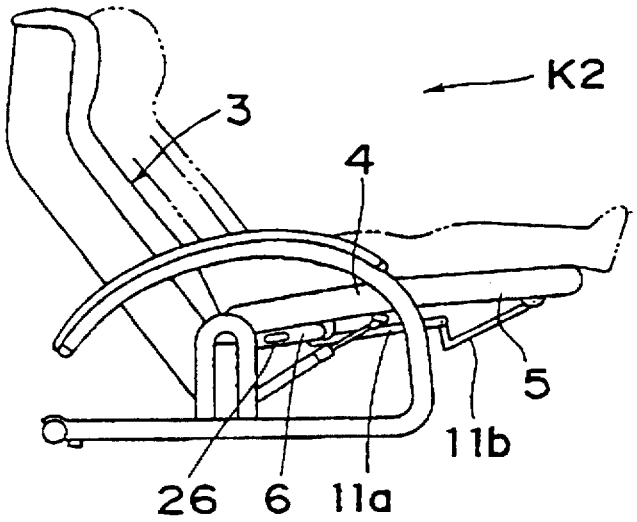
FIG. 18 is a side elevational view of the massaging apparatus of FIG. 10 in which the operating lever is reversely gripped by the hand of the user.
Figure 19:
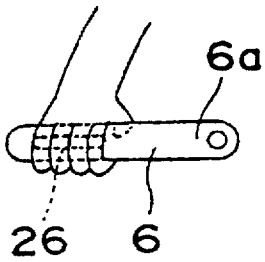
FIG. 19 is a fragmentary perspective view of the operating lever of FIG. 18.

In this embodiment, pivotal angle of the operating lever 6 is not less than 90° and the locking button 26 is provided on the outer side face 6*a* of the operating lever 6 as viewed from the seat 4. Hence, as shown in FIGS. 12 and 13, when the user grips the operating lever 6, the user can automatically depress the locking button 26 or cancel depression of the locking button 26 simultaneously as shown in FIG. 13. Meanwhile, even if the user grips the operating lever 6 reversely as shown in FIG. 19, the locking button 26 is disposed on the outer side face 6*a* of the operating lever 6, so that the locking button 26 is held in contact with the user's palm at all times, thereby resulting in rise of operating efficiency of the massaging apparatus K2.

Effects gained by the massaging apparatus of the present invention are described, hereinafter. Firstly, the massaging apparatus comprises the seat, the footrest which is pivotally mounted on the front end portion of the seat, the pivotal means for pivoting the footrest between the projecting position at which the footrest is substantially horizontally projected forwardly of the seat and the retractive position at which the footrest is retracted below the seat substantially vertically, the operating lever for actuating the pivotal means and the locking portion for effecting or cancelling locking of the footrest at the predetermined pivotal angle between the projecting position and the retractive position, which is provided on the operating lever. Hence, by operating the locking portion, the footrest can be locked also at the location intermediate between the projecting position and the retractive position. Therefore, even when the footrest is used without tilting the backrest, the user can take an easy attitude free from low back pain for a long time by directing his feet obliquely downwardly, thereby resulting in rise of usability of the massaging apparatus especially in the case of the aged, the physically handicapped and those suffering from low back pain or rheumatism. Furthermore, since the locking portion can be operated simultaneously with operation of the operating lever, angular adjustment of the footrest is facilitated, thus resulting in also rise of operating efficiency of the massaging apparatus. In addition, in case the footrest has a builtin massaging mechanism, stimulation given to the user by the footrest can be changed by changing angle of the footrest during massaging and thus, massaging effect can be further heightened.

Secondly, the locking portion includes the depressible locking button and the massaging apparatus further comprises the locking mechanism for locking the locking button in one of the depressed state and the nondepressed state of the locking button. Since the locking mechanism for locking the locking button is provided, the footrest can be fixed in position positively. Therefore, it is possible to prevent displacement of the footrest due to inadvertent operation of the locking button such as sudden impact applied to the locking button and children's mischief. In addition, operating efficiency of the massaging apparatus can be raised in case the footrest is set only at the projecting position.

Thirdly, the footrest is locked at a plurality of the pivotal angles between the projecting position and the retractive position by the locking portion. Therefore, even if the user releases his hand from the operating lever in the unlocking state of the footrest, the footrest can be locked at one of the pivotal angles, so that risk of abrupt drop of the footrest is eliminated, thereby resulting in rise of operational safety of the massaging apparatus.

Fourthly, the locking button is provided on the side face of the operating lever. Accordingly, the user can automatically effect or cancel depression of the locking button simultaneously with gripping the operating lever and thus, operating efficiency of the massaging apparatus is further improved.

Fifthly, the operating lever is pivoted through not less than 90° and the locking button is provided on the outer side face of the operating lever as viewed from the seat. Therefore, even when the user grips the operating lever reversely, the user's palm is held in contact with the locking button at all times and thus, operating efficiency of the massaging apparatus can be kept excellent.

What is claimed is:

1. A chair comprising:

a seat;

a footrest which is pivotally mounted on a front end portion of the seat;

pivotal means for pivoting the footrest between a projecting position at which the footrest is substantially horizontally projected forwardly of the seat and a retractive position at which the footrest is retracted below the seat substantially vertically;

an operating lever for actuating the pivotal means; and a locking portion for effecting or cancelling locking of the footrest at a pivotal angle between the projecting position and the retractive position, which is provided at the operating lever, said locking portion including a depressible locking button, which can lock in one of a depressed state and a non-depressed state, thereby causing either the locking or unlocking of the footrest at said pivotal angle.

2. A chair as claimed in claim 1, further comprising a locking mechanism for locking the locking button in said one of a depressed state and a nondepressed state of the locking button.

3. A chair as claimed in claim 1, wherein the footrest is locked at a plurality of pivotal angles between the projecting position and the retractive position by the locking portion.

4. A chair as claimed in claim 1, wherein the locking button is provided on a side face of the operating lever.

5. A chair as claimed in claim 1, wherein the operating lever is pivoted through not less than 90° and the locking button is provided on an outer side face of the operating lever as viewed from the seat.

6. A chair as claimed in claim 1, wherein the pivotal means includes a link mechanism.

7. A chair as claimed in claim 6, wherein the link mechanism includes two links.

8. A chair, comprising:

a seat;

a footrest which is pivotally mounted on a front end portion of said seat;

a pivoting device which pivots the footrest between a first position at which said footrest projects substantially horizontally forward of said seat, and a second position, at which said footrest is retracted below said seat and is substantially vertical;

an operating lever for actuating said pivoting device; and a locking portion which locks and unlocks said footrest at a pivotal angle between said first position and said second position, said locking portion being provided at said operating lever, said locking portion including a depressible locking button, lockable in one of a depressed state and a non-depressed state, thereby locking or unlocking said footrest at said pivotal angle.

9. The chair of claim 8, further comprising a locking mechanism which locks said locking button in said one of the depressed state and the non-depressed state of said locking button.

10. The chair of claim 8, wherein the footrest can be locked at a plurality of pivotal angles between said first position and said second position by the locking portion.

11. The chair of claim 8, wherein said locking button is provided on a side face of said operating lever.

12. The chair of claim 8, wherein said operating lever is pivoted through not less than 90° and said locking button is provided on an outer side face of said operating lever as viewed from said seat.

13. The chair of claim 8, wherein said pivoting device includes a link mechanism.

14. The chair of claim 13, wherein the link mechanism includes two links.

* * * * *